US006082624A

United States Patent [19]

Heinzelmann et al.

[11] Patent Number: 6,082,624

[45] Date of Patent: Jul. 4, 2000

[54] SAFETY DEVICE FOR SANITARY EQUIPMENT

[75] Inventors: Werner Heinzelmann, Alpirsbach; Werner Lorch, Schramberg, both of Germany

[73] Assignee: Hansgrohe AG, Schiltach, Germany

[21] Appl. No.: 08/498,905

[22] Filed: Jul. 6, 1995

[30] Foreign Application Priority Data

Jul. 7, 1994 [DE] Germany ..... 44 23 857

[51] Int. Cl.[7] ..... G05D 23/02

[52] U.S. Cl. ..... 236/93 B; 4/675; 137/872

[58] Field of Search ..... 236/93 B; 137/872; 4/668, 675–677

[56] References Cited

U.S. PATENT DOCUMENTS

| | | | |
|---|---|---|---|
| 3,086,748 | 4/1963 | Reinemann | 137/872 X |
| 3,291,391 | 12/1966 | Mesco | 236/93 B X |
| 3,441,054 | 4/1969 | Mellan | 137/872 |
| 4,210,284 | 7/1980 | Tarnay et al. | 239/75 |
| 4,480,784 | 11/1984 | Bennett | 236/93 B |
| 4,854,499 | 8/1989 | Neuman | 236/93 B |
| 4,989,640 | 2/1991 | Steffes et al. | 137/872 X |
| 5,123,593 | 6/1992 | Rundle | 236/93 B |
| 5,141,153 | 8/1992 | Jeffress | 236/93 B |
| 5,261,597 | 11/1993 | Perlman et al. | 236/93 R |

FOREIGN PATENT DOCUMENTS

| | | |
|---|---|---|
| 2402141 | 8/1978 | France . |
| 2384187 | 10/1978 | France . |
| 1484902 | 12/1968 | Germany . |
| 2416385 | 10/1975 | Germany . |
| 3108419 | 9/1982 | Germany . |
| 3713296 | 3/1988 | Germany . |
| 3834153 | 4/1989 | Germany . |
| 4224684 | 1/1994 | Germany . |

OTHER PUBLICATIONS

Patents Abstract of Japan, Mar. 2, 1984, vol. 8/No. 47.

Search report, German patent application serial number P 44 23 857.6.

*Primary Examiner*—William E. Tapolcai
*Attorney, Agent, or Firm*—Duane, Morris & Heckscher LLP

[57] ABSTRACT

A safety device for a sanitary equipment contains a reversing element, which reverses the water flow between two water passages located in a fitting housing. A temperature-sensitive element acts on the reversing element in such a way that when the latter reaches a given temperature limit it switches into one of the two positions of the reversing valve, said position being called the safety position. The water outlet associated with this safety position can e.g. be a bath outlet, which represents for the user a lower safety risk through the hot water than a shower.

12 Claims, 1 Drawing Sheet

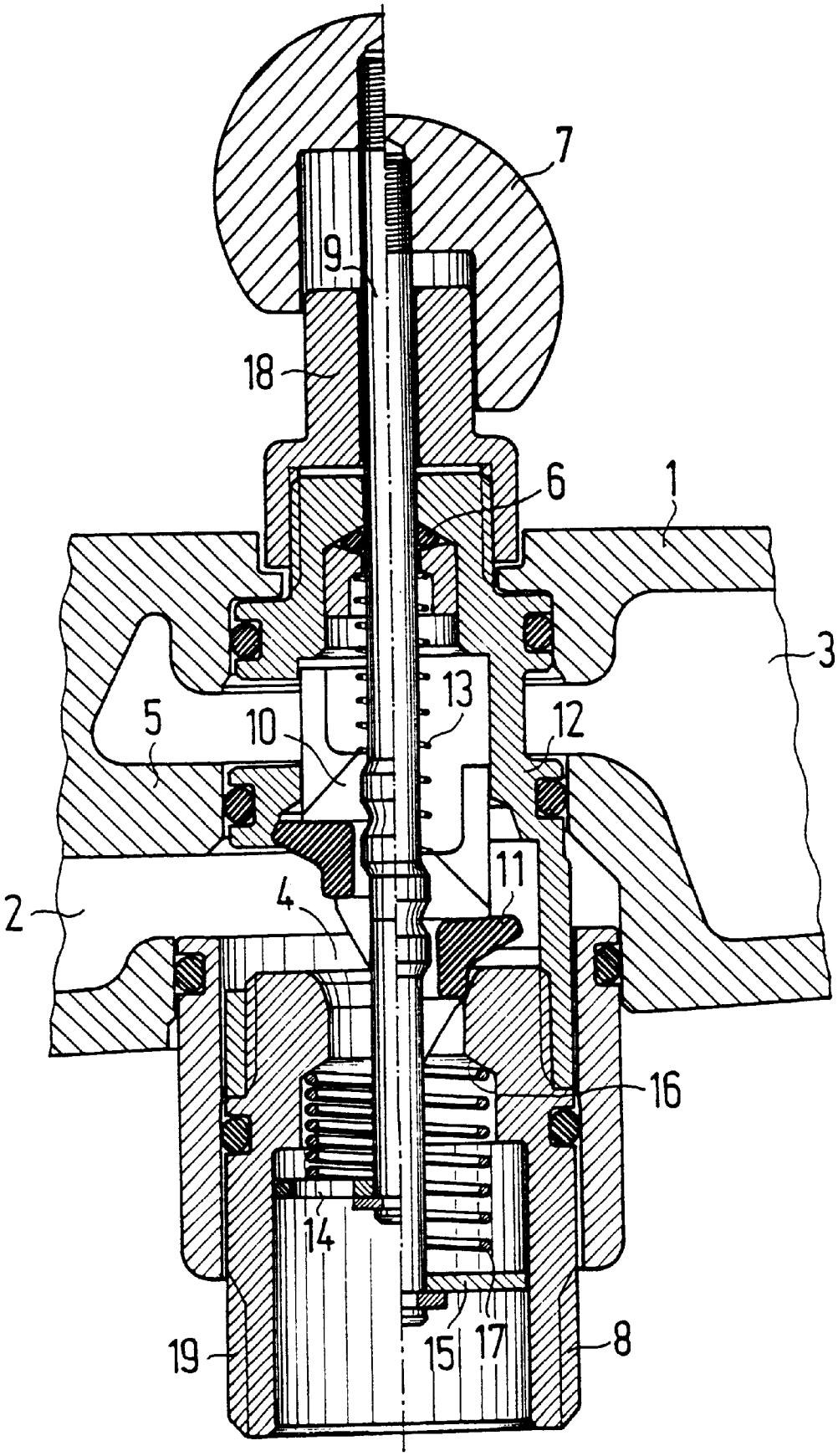
7
9
18
6
1
3
13
5
10
12
11
2
4
16
14
15
17
19
8

SAFETY DEVICE FOR SANITARY EQUIPMENT

The invention relates to a safety device for sanitary equipment. The term sanitary equipment is understood to cover e.g. a mixer valve with a bath outlet and a shower, but also covers a shower system only with one or more shower heads.

A mixer valve for a bath outlet and a shower is already known, in which in addition to the mixer valve and the shower reversing means there is a safety valve with a thermostat which, on reaching a given temperature, closes the shower outlet and on dropping below this temperature switches it on again. Therefore this mixer valve requires an additional valve. If the temperature of the shower water approaches the critical value, the thermostat gradually constricts the shower outlet, so that in the case of a long shower at a temperature just below the critical value only a very small amount of water can be delivered to the shower.

A shower head is also known (U.S. Pat. No. 4,210,284), in which a fitted thermostat on reaching a critical temperature firstly constricts and then closes a flow cross-section.

The problem of the invention is to provide a safety device for sanitary installations, which has a simple construction and involves only slight additional costs.

For solving this problem the invention proposes a safety device having the features of claim 1. Further developments of the invention form the subject matter of subclaims.

Thus, on reaching a critical temperature the reversing element serves to disconnect the water outlet. This obviates any risk of injury to the user through the hot water.

The safety device according to the invention is particularly suitable for any sanitary equipment, which has two water passages to in each case one water outlet and then, as a function of the position, the reversing element connects in one of the water passages and connects out the other. Therefore the reversing element is a part of the sanitary fitting, e.g. a reversing element switching between the shower outlet and the bath outlet. In this case and unlike in the prior art referred to hereinbefore, no additional valve is installed in the sanitary equipment and instead a reversing element, which forms a reversing valve, is mechanically subject to the action of a temperature-sensitive element, so that the sanitary equipment has a simple construction.

Naturally the reversing element is only reversed into the aforementioned position if it was previously in the other position. This position is referred to hereinafter as the safety position. The water passage associated with the safety position of the reversing element can lead to any device, which fulfils a safety function.

In particular, the water passage associated with the safety position can lead to a water outlet, which for a user represents a reduced or no risk.

According to a further development of the invention the temperature element is constructed in such a way that the reversing of the reversing element at the temperature limit is brought about suddenly. This avoids the aforementioned disadvantage of the prior art that with slowly rising temperature the flow cross-section of e.g. the shower device is gradually reduced.

The invention proposes that the reversing element, after reversal, even when the temperature drops further remains in the safety position. In this case it must then be reversed again manually or by another device, if the original position is to be reassumed.

According to the invention the reversing element can be operated manually for switching between the two water passages in at least one direction.

For example, the reversing element can be a so-called automatic shower reverser. This shower reverser is brought manually into a position associated with the shower outlet and remains in this position for as long as water flows. It is held in this position by the water pressure. As soon as the mixing valve is closed and the water pressure decreases, the shower reverser is forced back by a spring into a position associated with the bath outlet. The invention acts in a particularly appropriate and simple manner here, because the temperature sensor then only has to act on the shower reverser and the latter only has to be displaced by a small amount. Even in the case of a small displacement the bath outlet opens and the water pressure no longer holds the reverser in its shower position, so that the reverser can be brought into the position corresponding to the bath outlet by the spring. The bath outlet is much less of a hazard for the user than the shower.

According to the invention in place of a reversing element use can be made of a shutoff element, which is constructed like an automatic shower reverser, i.e. is kept open by the pressure of the flowing water and is closed with the aid of a spring in the case of a response of the temperature-sensitive element. In this case it could be a shutoff element, which is jointly operated with the opening of the mixer valve and is closed and remains closed at an excessive temperature.

According to the invention the water passage associated wit the safety position leads to a bath outlet, e.g. a bath tub outlet or a shower bath outlet, which can be positioned in the foot area. In this case the user can initially adjust the shower water temperature by means of a thermostat and then check with the foot whether he has found the correct temperature and then operates the shower reverser in order to take a shower.

It is also possible according to the invention for the water passage associated with the safety position to lead directly to the bath outlet, both in the case of a bath tub and a shower bath. In this case the user cannot come into contact with the hot water.

It is also possible according to the invention for the reversing element to be returned to the initial position when the temperature drops again. This is particularly advantageous if the water passage associated with the safety position leads to an unusable water outlet.

According to the invention the temperature-sensitive element has a bimetal, particularly a bimetallic spring. Particularly if the reversing element is constructed in the manner of a shower reverser, a bimetallic element can be sufficient on reaching the temperature limit to only initiate the reversing of the reverser, which then completely reverses the valve through the in any case present spring or due to the no longer one-sided water pressure. The temperature-sensitive element can e.g. be a wax element.

The invention also proposes using as the temperature-sensitive element an element made from a shape memory alloy (SMA), e.g. a spring. This shape memory alloy has the property of performing a sudden movement in a very narrow temperature range, so that here the effect of the gradual closure of an opening is avoided.

Further features, details and advantages can be gathered from the claims, whose wording is made by inference part of the content of the description, the following description of a preferred embodiment of the invention and the attached drawing, which is a partial section through a fitting housing with an automatic shower reverser located therein.

The drawing shows a horizontally directed part 1 of a sanitary fitting, which is entered by means of a duct 2 by water coming from a mixer valve and from which it passes to the right through a first water passage 3, e.g. to a bath outlet and through a second water passage 4 to a shower outlet.

In the sanitary fitting is provided a horizontally directed dividing wall, in which is placed a shower reverser 6. The shower reverser 6 projects out of the top of the sanitary fitting and is provided there with an operating grip or handle 7. The left-hand half of the shower reverser is shown in a position in which the water passage 4 leading to the shower outlet or connection 8 is supplied with water, whereas the right-hand half of the shower reverser 7 illustrates the position in which the water passage 3 leading to a bath outlet is supplied with water.

As a function of the position of the shower reverser 6 the water passes through the dividing wall 5 either to the bath outlet or to the shower outlet 8. The shower reverser 6 contains a displaceable valve rod 9, to which is fitted a valve closure 10 for reversing between the two water passages 3, 4 and said closure has an all-round seal 11. In the central position of the shower reverser 6 is formed a partition 12, with a central opening, filling the opening in the dividing wall 5. The marginal area of said opening on the underside of the partition 12 forms a valve seat cooperating with the seal or packing 11.

Above the valve closure 10 a compression spring 13 extends around the valve rod 9 and urges the shower reverser 6 into a position in which the shower outlet is closed, because the valve closure 10 with the seal 11 is engaged on the valve seat formed on the shower outlet 8.

To the lower end of the valve rod 9 is fixed a disk 15 provided with openings 14. The disk is located downstream of the valve seat in the shower connection 8. Between a shoulder 16 upstream of the valve seat for the shower connection 8 and the disk 15 is provided a second compression spring 17. The latter acts in the same direction as the first compression spring 13. This compression spring 17 forms a temperature-sensitive element, because it is made from a shape memory alloy (SMA). It is also possible to use a bimetallic element, a wax element, etc.

The shower reverser 6 is inserted from below in the openings of the fitting housing and is fixed from above with the aid of a sleeve nut 18. Various O-rings are used for sealing purposes. To the lower end of the shower connection 8 can be connected to the external thread 19 provided there a shower hose or an extension line.

The arrangement shown in the drawing operates as follows. For reversing the shower reverser 6 for supplying the shower outlet 8 with water, with the mixer valve open the shower reverser 6 is reversed upwards by drawing on the operating handle 7. In this position shown to the left in the drawing the water pressure acts on the underside of the closure 10 and keeps the reverser firmly in this position counter to the action of the compression spring 13. The water flows to the shower outlet 8. The temperature-sensitive compression spring 17 is dimensioned in such a way that at a shower water temperature acceptable for the user no spring tension is produced. However, as soon as a given temperature limit of e.g. 40° C. is reached, the spring tension of the SMA spring 17 suddenly changes, so that it now presses adequately strongly on the disk 15 and moves the operating rod 9 downwards. As soon as the valve closure 10 with its seal 11 is raised from the valve seat formed on the partition 12, the water pressure no longer acts on the valve closure 10 on one side, so that the movement is now no longer impeded by the lack of a one-sided acting water pressure. The reversing element formed by the shower reverser 6 is now brought in a relatively jerky manner into a position in which the water outlet to the shower outlet is closed and the water outlet to the bath tub outlet is opened.

An automatic return to the shower outlet on dropping below said temperature is not provided in the represented embodiment.

The same reversing process occurs in the case of the reverser shown in the embodiment even if the mixer valve is closed, i.e. the water pressure stops.

In the represented embodiment the SMA compression spring 17 can be replaced by a bimetallic compression spring, provided that it is ensured that the expansion of the bimetal caused by the temperature rise only leads to a displacement of the valve rod 9 at the temperature limit. This can e.g. be achieved in that the bimetallic compression spring has in the state shown to the left in the drawing a smaller axial extension, i.e. does not yet engage on the shoulder 16.

In the represented embodiment a shower reverser is shown as part of a sanitary fitting, which is reversed between a bath tub outlet and a shower bath outlet.

It is also possible and falls within the scope of the invention in the case of a sanitary fitting with only a single water passage, i.e. for example a bath tub outlet without a shower outlet, to use a shutoff element, which is in principle constructed in the same way as an automatic shower reverser and in which the temperature-sensitive element proposed by the invention serves to bring about a disconnection of the bath tub outlet. In this case the shutoff element would be positioned in such a way that it would automatically be operated on opening the bath outlet, so as to associate with the latter the position associated with the shower outlet in the case of the shower reverser.

What is claimed is:

1. Safety device for sanitary equipment comprising: a fitting housing having a water inlet and a first and second water outlet, and a reversing element coupled to a temperature sensitive element, said reversing element being movable between a safety position in which the water inlet is in communion with the first water outlet and a manually selectable position in which the water inlet is in communication with the second water outlet, said temperature sensitive element upon reaching a given temperature limit reversing the reversing element from the manually selectable position into the safety position.

2. Safety device according to claim 1, wherein the second water outlet associated with the manually selectable position of the reversing element leads to a shower outlet.

3. Safety device according to claim 1, wherein the water passage (3) associated with the safety position of the reversing element (6) leads to a water outlet with a reduced danger potential.

4. Safety device according to claim 1, wherein the temperature-sensitive element is constructed in such a way that it suddenly responds on reaching the temperature limit.

5. Safety device according to claim 1, wherein, after the temperature sensitive element reverses the reversing element, even with the water temperature dropping again, the reversing element remains in the safety position.

6. Safety device according to claim 1, wherein the reversing element is an automatic shower reverser.

7. Safety device according to claim 1, wherein the reversing element is constructed like an automatic shower reverser.

8. Safety device according to claim 1, wherein the first water outlet associated with the safety position of the reversing element leads to a bath outlet.

9. Safety device according to claim 1, wherein the temperature-sensitive element has a bimetallic element, particularly a bimetallic spring, or is formed by the same.

10. Safety device according to claim 1, wherein the temperature-sensitive element has a SMA spring.

11. Safety device for sanitary equipment comprising: a fitting housing having a water inlet and a first and second water outlet, a reversing element movably coupled to a first and second spring, said reversing element being movable between a safety position in which the water inlet is in communication with the first water outlet and a manually selectable position in which the water inlet is in communication with the second water outlet, said first spring urging the reversing element into the safety position, said second spring being temperature sensitive and upon reaching a given temperature limit reversing the reversing element from the manually selectable position into the safety position.

12. Safety device of claim 11 wherein the reversing element has a valve rod with an upper and lower end and a perforated disk coupled to the lower end, said second spring being movably coupled to the perforated disk and upon reaching a given temperature limit, presses on the fitting housing and the perforated disk thereby reversing the reversing element from the manually selectable position into the safety position.

* * * * *